US005729883A

United States Patent [19]

Yoshioka et al.

[11] Patent Number: 5,729,883

[45] Date of Patent: Mar. 24, 1998

[54] METHOD OF PRODUCING A FORGING

[75] Inventors: Hideo Yoshioka, Miura; Makoto Oiyama, Hiratsuka; Yujiro Ohara, Kamakura; Kiyoshi Takagi, Tokyo, all of Japan

[73] Assignee: Nissan Motor Co., Ltd., Kanagawa, Japan

[21] Appl. No.: 493,551

[22] Filed: Jun. 23, 1995

[30] Foreign Application Priority Data

Sep. 30, 1994 [JP] Japan ..... 6-237553

[51] Int. Cl.[6] ..... B21B 1/46

[52] U.S. Cl. ..... 29/527.5; 29/894.32; 29/894.324; 72/352; 72/356

[58] Field of Search ..... 29/527.5, 894.324, 29/894.325, 894.32; 72/352, 356, 355.2

[56] References Cited

U.S. PATENT DOCUMENTS 4,408,379 10/1983 Kusano et al. .
4,624,038 11/1986 Walther .
5,065,510 11/1991 Ostermann et al. .
5,441,334 8/1995 Botterman et al. .
5,446,962 9/1995 Matossian et al. .

FOREIGN PATENT DOCUMENTS 55-144351 of 0000 Japan .
3-142031 6/1991 Japan .

*Primary Examiner*—Carl J. Arbes
*Attorney, Agent, or Firm*—Lowe, Price, LeBlanc & Becker

[57] ABSTRACT

A method of producing a disc of an automotive road wheel by using an aluminum alloy as a material. The producing method comprising the following steps: (1) casting a disc material including an annular spoke section which has a ridge and is formed with a depression, the depression defined by a bottom wall; and (2) forging the disc material to obtain the forged disc by applying a processing degree of not less than 15% to the bottom wall of the spoke section and by applying a stress of not less than 50 MPa to the ridge of the spoke section.

11 Claims, 7 Drawing Sheets

METHOD OF PRODUCING A FORGING

BACKGROUND OF THE INVENTION

1. Field of the Invention

This invention relates generally to improvements in production methods for a forging, more particularly to a method of fabricating a final forged product by forging a material fabricated by casting.

2. Description of the Prior Art

Hitherto, a method of producing a forged product by forging a cast material has been disclosed, for example, in Japanese Patent Provisional Publication No. 3-142031. In this producing method, first the material of a disc of an automotive road wheel is prepared by casting, in which the material of the disc is fabricated in a shape similar to that of the final forged product or disc. Thereafter, the cast disc material is forged to fabricate the disc of the automotive road wheel. Such a production method of the forged product facilitates the production process of the road wheel disc for automotive vehicles.

However, drawbacks have been encountered in the above discussed conventional production method of the road wheel disc, in which the material of the disc is fabricated to have the shape similar to that of the final forged product, and therefore a processing degree during forging is small. As a result, it is difficult to obtain strength improvement effects due to forging (for example, a finely dividing effect to dendrite produced during solidification in casting, and an effect due to generation of grain flow), and a smooth and highly glossy surface as a feature of a forged product.

SUMMARY OF THE INVENTION

It is an object of the present invention to provide an improved production method of a forging, which can effectively overcome drawbacks encountered in conventional similar production methods.

Another object of the present invention is to provide an improved production method of a forging, by which a forged product can be effectively improved in mechanical strength and surface quality as compared with that produced by conventional similar production methods.

A further object of the present invention is to provide an improved production method of a forging, in which a material is cast to fabricate a cast material which is followed by forging to obtain a final forged product, the shape of the cast material having a non-similarity relative to the shape of the final forged product.

An aspect of the present invention resides in a method of producing a forging, comprising the following steps in the sequence set forth: (1) casting a material having a predetermined shape which has a non-similarity relative to a shape of a final forged product; and (2) forging the material to obtain the final forged product. It will be understood that the terms "a predetermined shape which has a non-similarity" means a shape corresponding to the shape of the final forged product and therefore does not means a shape which largely different from the shape of the final forged product. In other words, when the cast material is forged at a processing degree of not less than 15%, the "predetermined shape having a non-similarity" is converted to the shape of final forged product.

Another aspect of the present invention resides in a method of producing a forging, comprising the following steps in the sequence set forth: (1) casting a material having a predetermined shape which has a non-similarity relative to a shape of a final forged product, the material including a major part having a dimension that at least one of a processing degree of not less than 15% and a stress of not less than 50 MPa is applicable to the material; and (2) forging the material to, obtain the final forged product which includes a major part corresponding to the major part of the material, the major part having a dimension obtained by applying at last one of a processing degree of not less than 15% and a stress of not less than 50 MPa, to the material.

A further aspect of the present invention resides in a method of producing a forged disc for a road wheel, comprising the following steps in the sequence set forth: (1) casting a disc material including an annular spoke section which has a ridge and is formed with a depression, the depression defined by a bottom wall; and (2) forging the disc material to obtain the forged disc by applying a processing degree of not less than 15% to the bottom wall of the spoke section and by applying a stress of not less than 50 MPa to the ridge of the spoke section.

A still further aspect of the present invention resides in a method of producing a forged disc for a road wheel, comprising the following steps in the sequence set forth: (1) casting a disc material including a hub installation section located at a central part of the disc material, an annular spoke section located around the hub installation section, the spoke section having a ridge and being formed with a depression, the depression being defined by a bottom wall; and (2) forging the disc material to obtain the forged disc, the forged disc including a hub installation section located at a central part of the disc material, an annular spoke section located around the hub installation section, the spoke section having a ridge and being formed with a depression, the depression being defined by a bottom wall; wherein the hub installation section of the disc material has a thickness which is not less than 130% of that of the hub installation section of the forged disc; the bottom wall of the depression has a thickness which is not less than 3 times that of the bottom wall of the forged disc; and the ridge of the disc material has a height which h not larger than ⅓ of that of the ridge of the forged disc.

According to the production method of the present invention in which the final product is produced by being subjected to both casting and forging a sufficient processing degree can be applied during the forging, and therefore the final product can exhibit a sufficient mechanical strength as same as that by forging while obtaining a smooth and glossy surface quality. Preferably, in case of applying the principle of the present invention to a disc of a road wheel for an automotive vehicle which disc has the hub installation section, and the annular spoke section having the ridge and being formed with the depression, the thickness of the hub installation section and the bottom wall of the spoke section depression and the height of the spoke section ridge are so set as to obtain a sufficient processing degree and/or stress. As a result, sufficient mechanical strength and surface quality depending Upon the processing degree can be provided to the road wheel disc or final product.

DETAILED DESCRIPTION OF THE INVENTION

According to the present invention, a method of producing a forging comprises the following steps in the sequence set forth: (1) casting a material having a predetermined shape which has a non-similarity relative to a shape of a final forged product; and (2) forging the material to obtain the final forged product.

More specifically, the method of producing a forging comprises the following steps in the sequence set forth: (1) casting a material having a predetermined shape which has a non-similarity relative to a shape of a final forged product, the material including a major part having a dimension that at least one of a processing degree of not less than 15% and a stress of not less than 50 MPa is applicable to the material; and (2) forging the material to obtain the final forged product which includes a major part corresponding to the major part of the material, the major part having a dimension obtained by applying at least one of a processing degree of not less than 15% and a stress of not less than 50 MPa, to the material.

Figure 4:
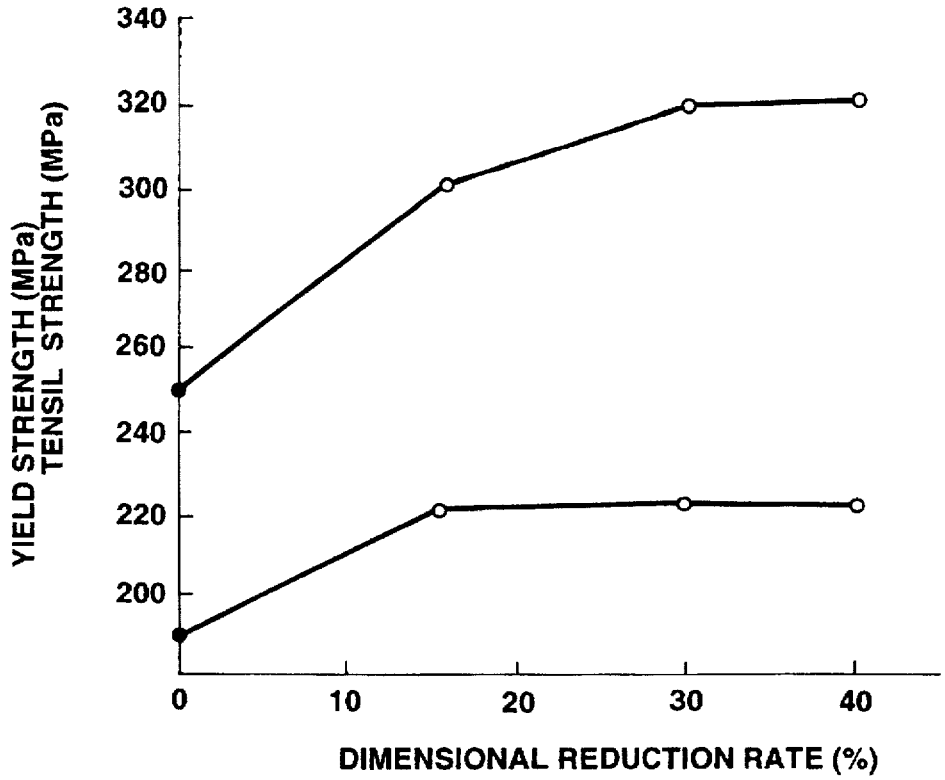
FIG. 4 is a graph showing tensile and yield strengths in terms of dimensional reduction rate (or processing degree), with respect a product fabricated according to the present invention.
Figure 5:
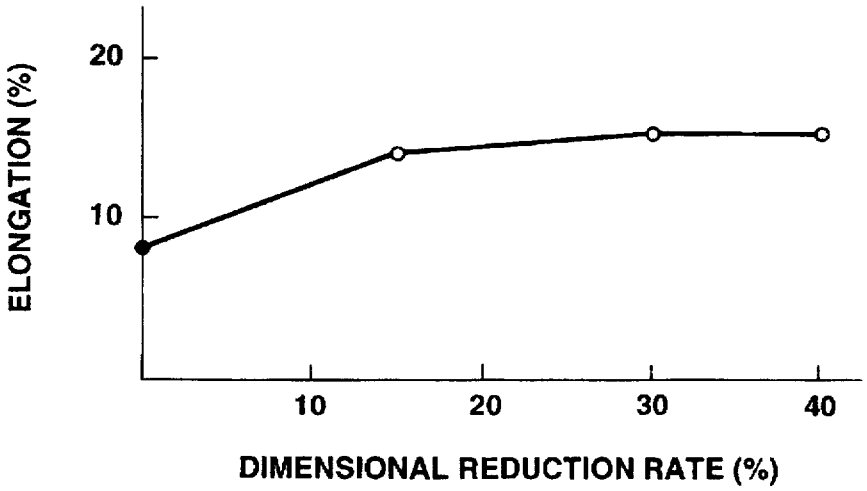
FIG. 5 is a graph showing an elongation (%) in tens of dimensional reduction rate with respect to a product fabricated according to the present invention.

In order to attain the principle of the present invention, researches and developments have been made conducting many experiments. In these experiments, the cast material which had been fabricated under casting was subjected to forging to obtain a forging or forged product. Then, measurements were made on a change in tensile strength and yield strength (MPa) in terms of a change in dimensional (thickness or height) reduction rate, of the forging. The :result of the measurements is shown in FIG. 4. Further measurements were made on a change in elongation (%) in terms of a change in dimensional reduction rate, of the cast material. The result of these measurements is shown in FIG. 5. Prior to conducting the measurements of FIGS. 4 and 5, the forging or forged product was subjected to a so-called T6 treatment (a quench hardening followed by an artificial age hardening) after the forging. A test piece (the cast material or the forged product) used in the experiments (the measurements) was made of an aluminum alloy (No. 6061 according to Japanese industrial Standard).

The above-mentioned dimensional reduction rate is also referred to as "processing degree" and means the percentage of minimum reduction in dimension (thickness or height) throughout a part (to which forging is applied) of the forging relative to the cast material before forging. Accordingly, the "dimensional reduction rate (processing degree)" is represented by the following equation:

$$\text{Dimensional Reduction Rate (\%)}=[(H-h)/H]\times 100$$

where H is the dimension of the part of the cast material before the forging; h is the dimension of the part of the cast material after the forging.

FIG. 4 demonstrates that a yield strength of not less than about 220 MPa and a tensile strength of not less than about 300 MPa of the forging are obtained at the dimensional reduction rate or processing degree of not less than 15%. FIG. 5 demonstrates that an elongation of not less than 14% is obtained at the dimensional reduction rate or processing degree of not less than 15%.

Furthermore, studies were conducted to obtain the relationship between stress (internal compressive stress) applied to the forging (forged product obtained after the casting) and mechanical property of the forging. These studies have revealed that the forging exhibited an excellent mechanical property having a yield strength of not less than about 220 MPa, a tensile strength of not less than about 300 MPa and an elongation of not less than 14%, in case that a stress of not less than 50 MPa was applied to the cast material under the forging. Thus, it is preferable that at least one of the dimensional reduction rate (processing degree) of not less than 15% and the stress of not less than 50 MPa is applied at a major part of the forging (forged product) during forging. The "major part" means a part which is functionally important in the forged product when used in practice. By virtue of application of such a dimensional reduction rate and/or the stress, the forged product can be significantly improved in mechanical strength owing to effectively obtaining a finely dividing effect to dendrite produced during solidification in casting and to the effect due to generation of grain flow, while attaining a smooth and highly glossy surface as a feature of the forged product.

In connection with the above, in practice, the dimensional reduction rate (processing degree) is applied to a part of the casting (cast product) which part is reduced in dimension (thickness or height) after forging. However, the dimensional reduction rate is difficult to be applied on or expressed for a part which is subjected to plastic flow under forward pressing, rearward pressing or upsetting. Accordingly, the stress is used or applied to such a part as to be subjected to the plastic flow.

Figure 8:
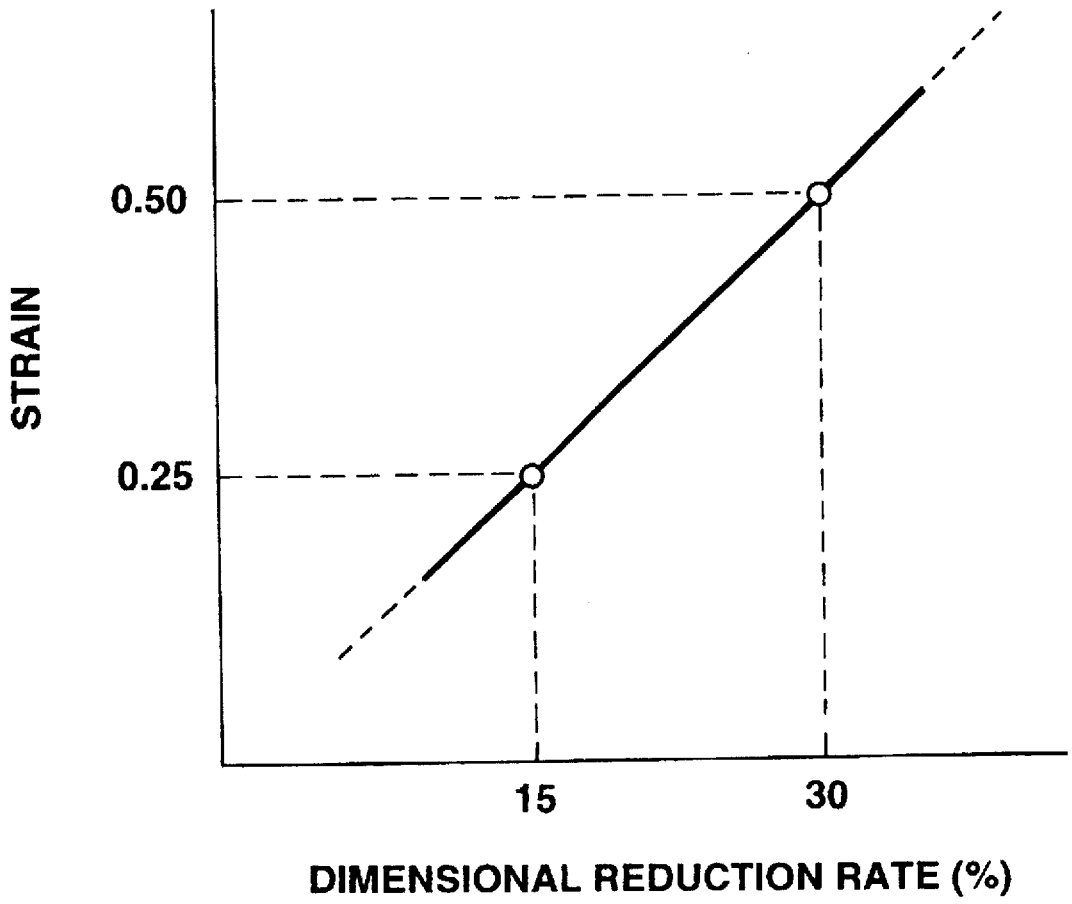
FIG. 8 is a graph showing strain in terms of dimensional reduction rate with respect to a product fabricated according to the present invention.

Studies were further conducted to obtain the relationship between the dimensional reduction rate (processing degree) and strain applied to the cast material during the forging. These studies revealed the proportional relationship existing between then: as shown in FIG. 8. Accordingly, it will be appreciated that also by applying the strain of not less than 0.25 (corresponding to elongation of not less than 25%) to the cast material during forging in place of application of the dimensional reduction rate of not less than 15%, the forged product (such as a disc of a road wheel or other mechanical elements) having excellent mechanical strength and high surface quality can be effectively produced.

Figure 1A:
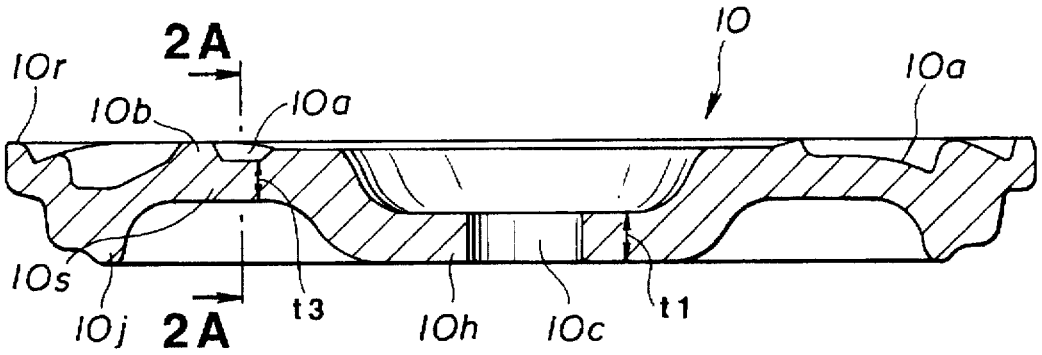
FIG. 1A is a vertical sectional view of a cast disc material for a road wheel disc in connection with an embodiment of a method of producing a forging, according to the present invention.

Referring now to FIGS. 1A to 5 of the drawings, an embodiment of a production method of a forging, according to the present invention will be distressed. In this embodiment, the principle of the present invention is applied to production of a disc (as the forging) for a road wheel of an automotive vehicle. FIG. 1A shows a disc material 10 which is formed by casting, whereas FIG. 1B shows the disc 12 which is formed by forging the disc material 10.

The disc material 10 in this embodiment is made of an aluminum alloy (for example, No. 6061 according to Japanese Industrial Standard) and has at a central part a circular hub installation section **10*h* which is formed depressed (in FIG. 1A) or projected to the inboard side of the load wheel. An annular spoke section 10*s* is formed integral with and located around the hub installation section 10*h*. The spoke section 10*s* is integrally connected at its inner periphery with the hub installation section 10*h* at the outer periphery, and extends radially outwardly. An annular inner rim joining section 10*j* is located around the spot-e section 10*s* and integral with the outer peripheral portion of the spoke section 10*s*. Additionally, an annular outer rim 10r is located around and integral with the inner rim joining section 10*j*. The hub installation section 10*h* is formed at its central portion with a hole 10*c* for allowing the material to flow during forging. Additionally, the spoke section 10*s* includes a depression portion 10*a* which has a bottom wall having a thickness t3. The spoke section 10*s* further includes a ridge portion 10*b* located adjacent the depression portion 10*a* and defining the depression portion 10*a***.

Figure 1B:
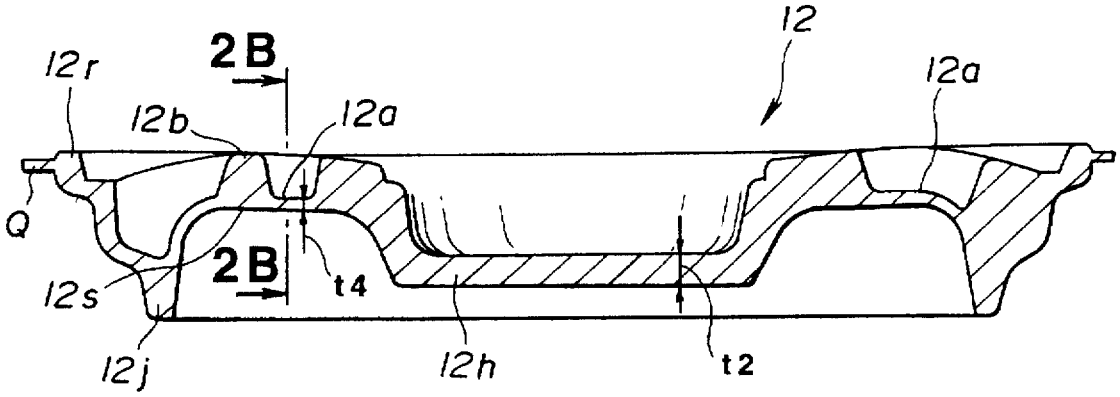
FIG. 1B is a vertical sectional view of a forged disc fabricated from the cast material of FIG. 1A.
Figure 1C:
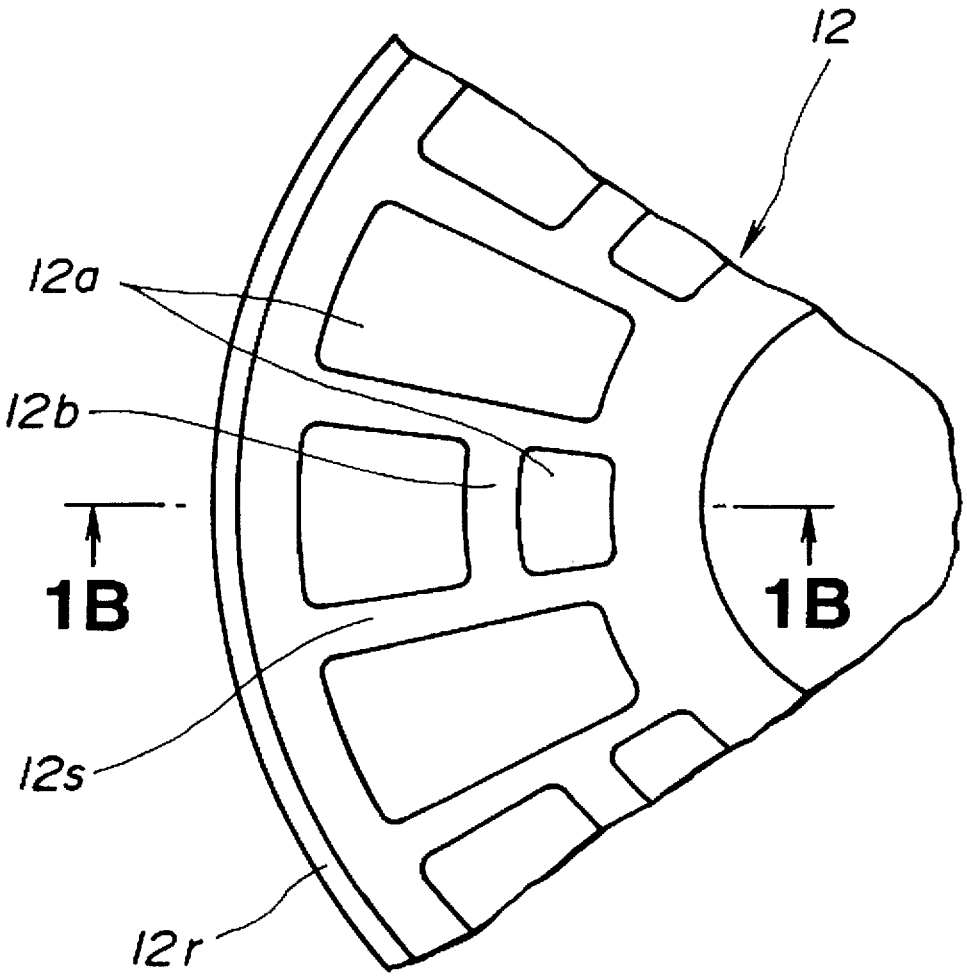
FIG. 1C is a fragmentary front elevation of the forged disc of FIG. 1B, in which the vertical sectional view of FIG. 1B is taken in the direction of arrows substantially along the line 1B—1B.

The above disc material 10 is subjected to forging to obtain a final forged product or forged disc D shown in FIG. 1B. It will be appreciated that the shape of the disc material 10 is considerably different from or has a non-similarity relative to that of the forged disc 12. The forged disc 12 has a circular hub installation section **12*h*, an annular spoke section 12*s*, an annular inner rim joining section 12*j* and an annular outer rim 12*r* which respectively correspond to the circular hub installation section 10*h*, the annular spoke section 10*s*, the annular inner rim joining section 10*j* and the annular outer rim 10*r* of the disc material 10. An inner rim (not shown) is to be fixedly joined to the inner rim joining section 10*j*. The spoke section 12*s* includes a depression portion 12*a* and a ridge portion 12*b* which are respectively correspond to the depression portion 10*a* and the ridge portion 10*b* of the disc material 10. In the production method of this embodiment, during the forging, the dimensional reduction rate (processing degree) of not less than 15% is applied to the depression portion 10*a* to form the depression portion 12*a* while the stress of not less than 50 MPa is applied to the ridge portion 10*b* to form the ridge portion 12*b***.

It will be appreciated that not less than 15% of the processing degree is preferable to obtain a predetermined strength (a strength same as a forged product) of the forged test piece or product in case of using the aluminum alloy (No. 6061) and employing both the casting and forging. The disc 12 requires a higher strength in the order of its outer rim **12*r*, the spoke section 12*s* and the hub installation section H. In order to meet this requirement, it is also preferable that the outer rim 12*r* and the spoke section 12*s*** obtain a processing degree of not less than 15%.

Figure 2A:
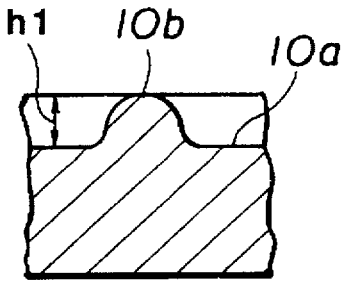
FIG. 2A is an enlarged fragmentary sectional view taken in the direction of arrows substantially along the line 2A—2A of FIG. 1A.
Figure 2B:
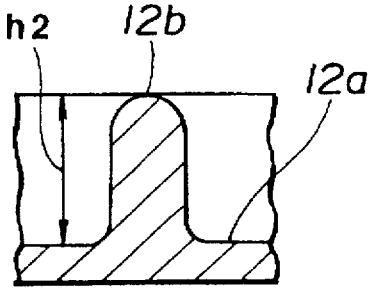
FIG. 2B is a fragmentary sectional view taken in the direction of a:rows substantially along the line 2B—2B of FIG. 1B.

Accordingly the disc material 10 is cast to have a shape by which a processing degree of not less than 15% can be obtained during forging. More specifically, in this case, the hub installation section **10*h* of the disc material 10 has a thickness t1 which is not less than 130% of that of the hub installation section 12*h* of the forged disc 12. The bottom wall of the depression portion 10*a* has a thickness t3 which is not less than 3 times that t4 of the bottom wall of the depression 12*a* of the forged disc 12. Additionally, as shown in FIGS. 2A and 2B, the ridge portion 10*b* has a height h1 which is not larger than ⅓ of that h2 of the ridge portion 12*b* of the forged disc 12**.

Figure 3:
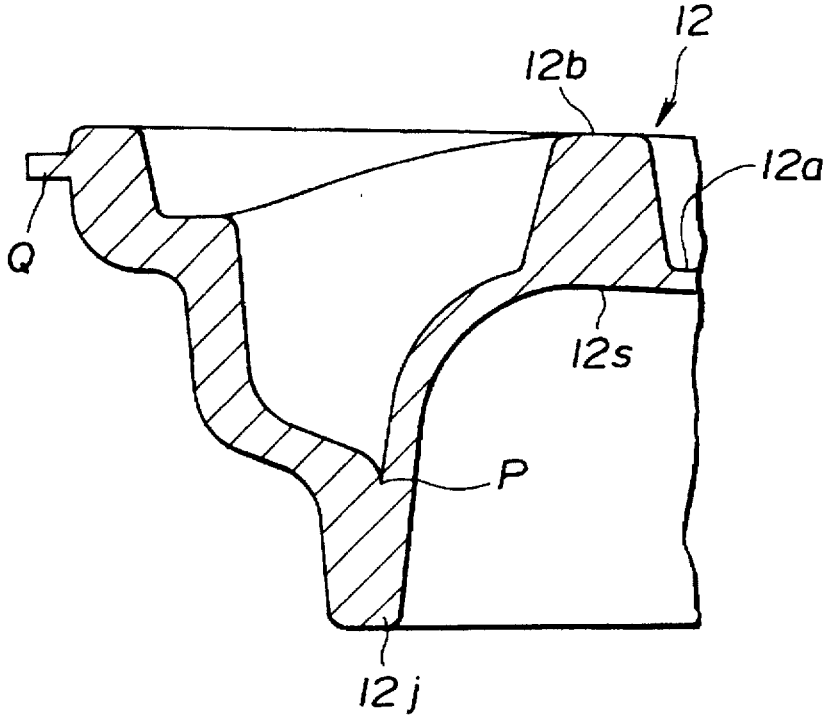
FIG. 3 is an enlarged fragmentary sectional and explanatory view for explaining a forging defect which can be prevented from occurrence during the forging of the disc of FIGS. 1A and 1B

Concerning the inner rim joining section **12*j*, there is the possibility of a forging defect such as a crack P arising owing to two flows of the material made toward a projecting part during forging, as shown in FIG. 3. Accordingly, the inner rim joining section 10*j* before forging has the same volume as the inner rim joining section 12*j* after forging. Concerning the outer rim section 12*r*, there is the possibility of a part of the material of the outer rim section 10*r*** flowing outwardly of a forging die to form burr Q as shown in FIG. 3, it is preferable to make a dimensional setting taking account of an amount of the material corresponding to the burr.

According to the forging production method of the present invention, the cast disc material 10 is fabricated into the disc 12 by forging, in which the processing degree of the disc material 10 during the forging is not less than 15%. As a result, a sufficient strength due to the forging can be provided to the final product or forged disc 12, while a smooth and glossy surface as a feature of the forging can be provided to l:he same final product. Additionally, the forged disc 12 is integrally formed with the outer rim section **12*r*, and therefore a sufficient strength and a high surface quality due to forging can be provided to the outer rim section 12*r* which are required to have the highest strength in the disc 12 and constitutes n major part of the external appearance of the disc 12**.

After the forging, the disc 12 is subjected at its inboard side surface to a machining such as cutting work, so that the bottom wall of the depression portion **12*a* is removed to form a through-hole. The road wheel including the disc 12 of this case is of a so-called two piece type wherein the road wheel is constituted of the disc 12 having the outer rim section 12*r* and the inner rim (not shown) which is separately produced. Therefore, the road wheel is completed by fixedly joining the inner rim to the inner rim joining section 12*j* of the disc 12**, for example, by welding.

Figure 6B:
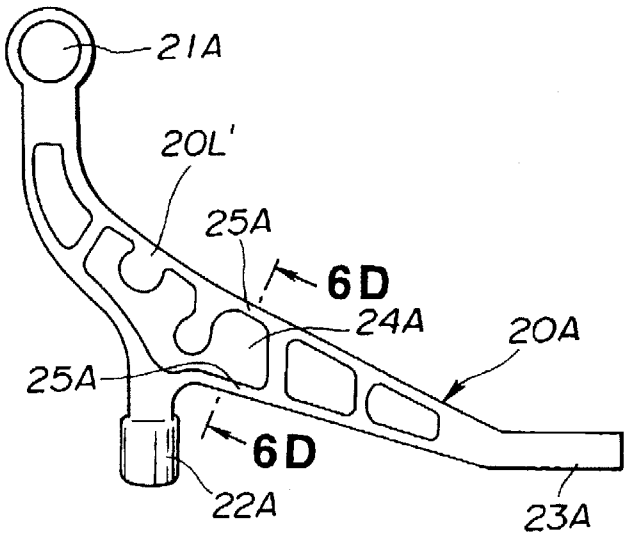
FIG. 6B is a side view of a forged suspension transverse link fabricated from the cast link material of FIG. 6A.
Figure 6D:
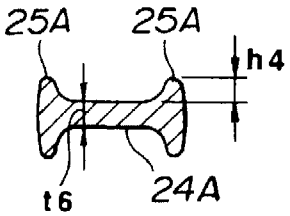
FIG. 6D is a cross-sectional view taken in the direction of arrows substantially along the line 6D—6D of FIG. 6B.
Figure 6A:
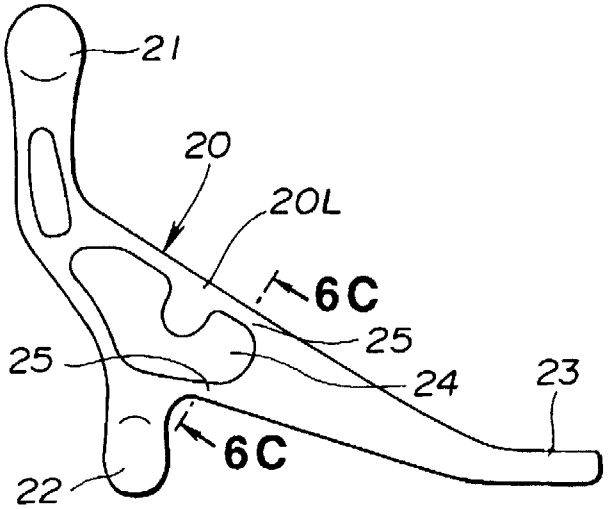
FIG. 6A is a side view of a cast link material for a suspension transverse link, in connection with another embodiment of,the forging producing method according to the present invention.

Figs, 6A to 6D illustrate another embodiment of the forging producing method according to the present invention, which similar to the embodiment of FIGS. 1A to 3. In this embodiment, the principle of the present invention is applied to a transverse link used in a suspension (particularly in a front suspension) of an automotive vehicle. In this embodiment, first a link material 20 shown in FIG. 6A is fabricated by casting. Then, the cast link material 20 is fabricated by forging thereby to obtain the transverse link 20A shown in FIG. 6B.

Figure 6C:
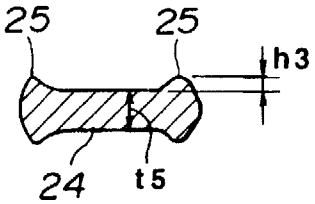
FIG. 6C is a cross-sectional view taken in the direction of arrows substantially long the line 6C—6C of FIG. 6A.

The link material 20 is made of an aluminum alloy and has three support sections 21, 22, 23. The three support sections 21, 22, 23 are integrally connected through a link section 20L. The link section 20L includes a central web 24, and side ribs 5, 5 located on the opposite sides of the web 24 so as to have a generally H-shaped cross-section as shown in FIG. 6C.

Similarly, the transverse link 20A has three support sections 21A, 22A 23A and a link section 20L' which are respectively correspond to the three support sections 21, 22, 23 and the link section 20L of the link material 20. The link section 20L' has a web 24A and side ribs 25A, 25A which correspond respectively to the web 24A, the side ribs 25, 25 of the link material 20. The transverse link 21 has a generally H-shaped cross-section as shown in FIG. 6D. It will be understood that the transverse link 21 is supported at its three points (21A, 22A, 23A) in the suspension.

It will be appreciated that the shape of the link material 20 has a non-similarity, as a whole, to that of the transverse link 21 as a final product.

Here, in order to obtain the predetermined strength (a strength as same as a forged product) of the final product or transverse link 20A according to the producing method in which forging is accomplished after casting, it is preferable to make forging at a processing degree of not less than 15%. In other words, the link material 20 is cast to have a shape by which the processing degree of not less than 15% can be obtained during forging.

Accordingly, the web 24 of the link material 20 has a thickness t5 which is not less than 130% of that of the web 24A of the transverse link 20A or final product (after forging). The thickness t5 corresponds to the thickness of the bottom wall of a depression portion of the link material 20. Additionally, the rib 25 of the link material 20 has a height h3 which is not more than ½ of the height t4 of the rib 25A of the transverse link or final product (after forging). The height h3 corresponds to the height of a ridge portion of the link material 20. Thus, a processing degree of not less than 15% is obtained in the transverse link 20A which is formed by forging the link material 20.

Figure 7:
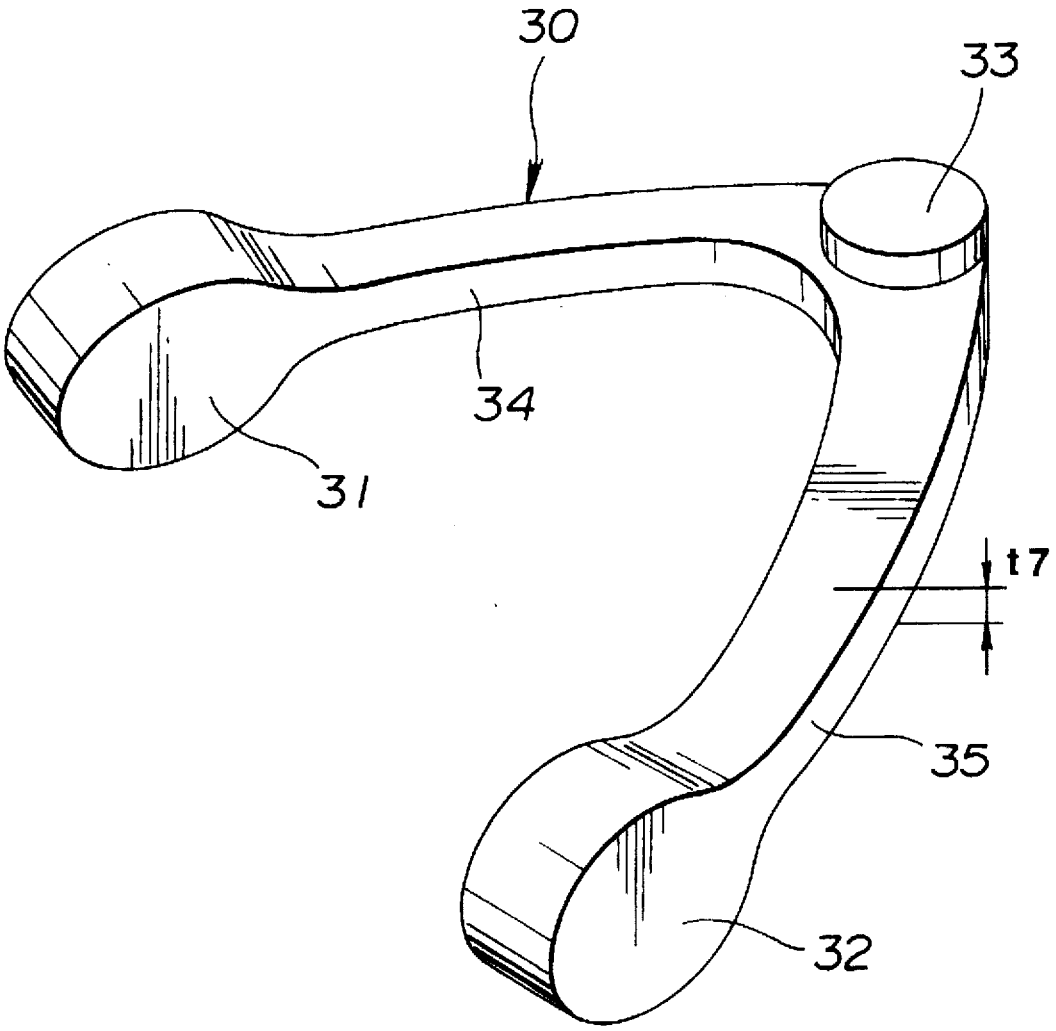
FIG. 7 is a perspective view of a suspension upper control link in connection with a further embodiment of the forging producing method according to the present invention.

FIG. 7 illustrates a further embodiment of the forging producing method according to the present invention, which is similar to the above embodiments. In this embodiment, the principle of the present invention is applied to an upper control link used in a suspension (particularly in a front suspension) of an automotive vehicle. In this embodiment, an upper control am 30 as shown in FIG. 7 is fabricated by forging a material (not shown) which is fabricated by casting. The shape of the material has a non-similarity to that of the upper control arm 30 as a final product.

The upper control arm 30 includes three support sections 31, 32, 33 through which the control arm 30 is supported in the suspension. Two arm sections 34, 35 are formed integral with the support sections 31, 32, 33 to connect the support sections. Each arm section 34, 35 has a rectangular cross-section.

In this embodiment, a section of the above-mentioned material corresponding to each arm section 34, 35 of the upper control arm 30 has a thickness which is not less than 130% of that t7 of the arm section 34, 35 of the upper control arm 30 (after forging). Thus, a sufficient processing degree of not less than 15% is applied to the upper control arm 30.

What is claimed is:

1. A method of producing a forging, comprising the following steps in the sequence set forth:

casting a material having a predetermined shape; and forging said material to obtain a final forged product, under a processing degree of not less than 15%.

2. A method as claimed in claim 1, wherein the step of casting includes casting an outer rim to be integral with said disc.

3. A method as claimed in claim 1, wherein said cast material includes a section having a generally H-shaped cross-section so as to form a web and ribs, and said final forged product includes a section having a generally H-shaped cross-section so as to form a web and ribs,wherein said web of said cast material has a thickness which is not less than 130% of that of said web of said final forged product, and each rib of said cast material has a height which is not larger than ½ of that of each rib of said final forged product.

4. A method as claimed in claim 1, wherein said cast material includes a section having a rectangular crosss-section, and said final forged product includes a section having a rectangular cross-section, wherein said section of said cast material has a thickness which is not less than 130% of that of said section of said final forged product.

5. A method of producing a forging, comprising the following steps in the sequence set forth;

casing a material having a predetermined shape which has a non-similarity relative to a shape of a final forged product, said material including a major part having a dimension that at least one of a processing degree of not less than 15% and a stress of not less than 50 MPa is applicable to said material; and forging said material to obtain the final forged product which includes major a part corresponding to the major part of said material, said major part of the final forged product having a dimension obtained by applying at least one of a processing degree of not less than 15% and a stress of not less than 50 MPa, to said material.

6. A method as claimed in claim 5, wherein said major part includes at least one of a first portion and a second portion, wherein the step of forging includes at least one of reducing a thickness of the first portion at the processing degree of not less 15%, and applying a plastic flow to the second portion at the stress of not less than 50 MPa.

7. A method as claimed in claim 5, wherein said major part of sad final forged protract has a dimension obtained by applying at least one of a processing degree of not less than 15%, a stress of not less than 50 MPa and a strain of not less than 0.25, to the material.

8. A method of producing a forged disc for a road wheel, comprising the following steps in the sequence set forth;

casting a disc material including an annular spoke section which has a ridge and is formed with a depression, said depression defined by a bottom wall; and forging said disc material to obtain the forged disc by applying a processing degree of not less than 15% to said bottom wall of said spoke section and by applying a stress of not less than 50 MPa to said ridge of said spoke section.

9. A method as claimed in claim 8, wherein the step of casting includes casting an outer rim to be integral with sad disc.

10. A method of producing a forged disc for a road wheel, comprising the following steps in the sequence set forth:

casting a disc material including a hub installation section located at a central part of said disc material, an annular spoke section located around said hub installation section, said spoke section having a ridge and being formed with a depression, said depression being defined by a bottom wall;

forging said disc material to obtain the forged disc, the forged disc including a hub installation section located at a central part of said disc material, an annular spoke section located around said hub installation section, said spoke section having a ridge and being formed with a depression, said depression being defined by a bottom wall;

wherein said hub installation section of said disc material has a thickness which is not less than 130% of that of said hub installation section of said forged disc; said bottom wall of said depression has a thickness which is not lees than 3 times that of said bottom wall of said forged disc; and said ridge of said disc material has height which is not larger than ⅓ of that of said ridge of said forged disc.

11. A method of forging an article from a predetermined material comprising the steps of:

casting the material to form an article which has a first predetermined shape; and forging the article to form a second predetermined shape which is distinctly different from the first predetermined shape and in a manner wherein essentially every portion of the article is distorted from its original shape, a processing degree is not less than 15%, and a stress of not less than 50 MPa is applied to the material.

* * * * *